US010024113B2

(12) United States Patent
DiGiovanni et al.

(10) Patent No.: US 10,024,113 B2
(45) Date of Patent: Jul. 17, 2018

(54) CUTTING ELEMENTS HAVING A NON-UNIFORM ANNULUS LEACH DEPTH, EARTH-BORING TOOLS INCLUDING SUCH CUTTING ELEMENTS, AND RELATED METHODS

(71) Applicant: Baker Hughes Incorporated, Houston, TX (US)

(72) Inventors: Anthony A. DiGiovanni, Houston, TX (US); David A. Stockey, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 15/654,966

(22) Filed: Jul. 20, 2017

(65) Prior Publication Data

US 2017/0314334 A1 Nov. 2, 2017

Related U.S. Application Data

(63) Continuation of application No. 14/248,008, filed on Apr. 8, 2014, now Pat. No. 9,714,545.

(51) Int. Cl.
*E21B 10/573* (2006.01)
*B22F 3/24* (2006.01)
(Continued)

(52) U.S. Cl.
CPC ..... *E21B 10/573* (2013.01); *B22F 3/24* (2013.01); *B22F 7/06* (2013.01); *C22C 26/00* (2013.01);
(Continued)

(58) Field of Classification Search
CPC .... E21B 10/573; E21B 2010/565; B22F 7/06; B22F 3/24; B22F 2005/001; B22F 2003/244; C22C 26/00
See application file for complete search history.

(56) References Cited

U.S. PATENT DOCUMENTS 4,224,380 A 9/1980 Bovenkerk et al.
5,011,515 A 4/1991 Frushour
(Continued)

FOREIGN PATENT DOCUMENTS

AU 2005243867 A1 5/2005
CA 2566597 A1 11/2005
(Continued)

OTHER PUBLICATIONS

Cheng, U.S. Appl. No. 13/947,723, entitled Thermally Stable Polycrystalline Compacts for Reduced Spalling Earth-Boring Tools Including Such Compacts, and Related Methods, filed Jul. 22, 2013.
(Continued)

*Primary Examiner* — Michael R Wills, III
(74) *Attorney, Agent, or Firm* — TraskBritt

(57) ABSTRACT

Polycrystalline diamond compact (PDC) cutting elements include leached and un-leached regions. The leached region may be or include a leached annular region. An inner boundary of the leached annular region remote from a side surface of the polycrystalline diamond may have a non-linear profile in a plane extending through the PDC cutting element along a longitudinal axis of the cutting element. Methods of forming PDC cutting elements include configuring polycrystalline diamond of a PDC cutting element to have such a leached annular region with a non-linear profile. Earth-boring tools may be formed that include such PDC cutting elements.

20 Claims, 7 Drawing Sheets

(51) Int. Cl.

| | |
|---|---|
| ***B22F 7/06*** | (2006.01) |
| ***C22C 26/00*** | (2006.01) |
| *B22F 5/00* | (2006.01) |

(52) U.S. Cl.
CPC ... *B22F 2003/244* (2013.01); *B22F 2005/001* (2013.01)

(56) References Cited

U.S. PATENT DOCUMENTS

| | | | |
|---|---|---|---|
| 5,127,923 | A | 7/1992 | Bunting et al. |
| 5,172,778 | A | 12/1992 | Tibbitts et al. |
| 5,472,376 | A | 12/1995 | Olmstead et al. |
| 5,605,198 | A | 2/1997 | Tibbitts et al. |
| 5,669,271 | A | 9/1997 | Griffin et al. |
| 5,709,279 | A | 1/1998 | Dennis |
| 5,711,702 | A | 1/1998 | Devlin |
| 5,787,022 | A | 7/1998 | Tibbitts et al. |
| 5,829,541 | A | 11/1998 | Flood et al. |
| 5,862,873 | A | 1/1999 | Matthias et al. |
| 5,906,246 | A | 5/1999 | Mensa-Wilmot et al. |
| 5,950,747 | A | 9/1999 | Tibbitts et al. |
| 6,011,232 | A | 1/2000 | Matthias |
| 6,021,859 | A | 2/2000 | Tibbitts et al. |
| 6,045,440 | A | 4/2000 | Johnson et al. |
| 6,193,001 | B1 | 2/2001 | Eyre et al. |
| 6,202,772 | B1 | 3/2001 | Eyre et al. |
| 6,601,662 | B2 | 8/2003 | Matthias et al. |
| 6,991,049 | B2 | 1/2006 | Eyre et al. |
| 7,165,636 | B2 | 1/2007 | Eyre et al. |
| 7,533,740 | B2 | 5/2009 | Zhang |
| 7,712,553 | B2 | 5/2010 | Shamburger |
| 8,172,012 | B2 | 5/2012 | Achilles |
| 8,197,936 | B2 | 6/2012 | Keshavan |
| 8,277,722 | B2 | 10/2012 | DiGiovanni |
| 8,353,371 | B2 | 1/2013 | Cooley et al. |
| 8,535,400 | B2 | 9/2013 | Belnap et al. |
| 8,567,531 | B2 | 10/2013 | Belnap et al. |
| 8,721,752 | B2 | 5/2014 | Fuller et al. |
| 8,764,864 | B1 | 7/2014 | Miess et al. |
| 8,783,389 | B2 | 7/2014 | Fan et al. |
| 8,800,692 | B2 | 8/2014 | Scott et al. |
| 8,821,604 | B2 | 9/2014 | Sani |
| 8,839,889 | B2 | 9/2014 | DiGiovanni et al. |
| 8,863,864 | B1 * | 10/2014 | Miess ..... E21B 10/5673 175/331 |
| 8,899,358 | B2 | 12/2014 | Yu et al. |
| 8,978,789 | B1 | 3/2015 | Sani et al. |
| 8,985,248 | B2 | 3/2015 | DiGiovanni et al. |
| 8,999,025 | B1 | 4/2015 | Miess et al. |
| 9,103,172 | B1 | 8/2015 | Bertagnolli et al. |
| 9,316,059 | B1 | 4/2016 | Topham et al. |
| 2001/0003932 | A1 | 6/2001 | Packer |
| 2002/0071729 | A1 | 6/2002 | Middlemiss et al. |
| 2002/0074168 | A1 | 6/2002 | Matthias et al. |
| 2002/0079140 | A1 | 6/2002 | Eyre et al. |
| 2003/0037964 | A1 | 2/2003 | Sinor |
| 2003/0079918 | A1 | 5/2003 | Eyre et al. |
| 2006/0165993 | A1 | 7/2006 | Keshavan |
| 2007/0039762 | A1 | 2/2007 | Achilles |
| 2007/0144790 | A1 | 6/2007 | Fang et al. |
| 2008/0206576 | A1 | 8/2008 | Qian et al. |
| 2009/0022952 | A1 | 1/2009 | Keshavan |
| 2010/0012389 | A1 | 1/2010 | Zhang et al. |
| 2010/0186304 | A1 | 7/2010 | Burgess et al. |
| 2010/0236837 | A1 | 9/2010 | Achilles |
| 2010/0242375 | A1 | 9/2010 | Hall et al. |
| 2010/0288564 | A1 | 11/2010 | Dovalina et al. |
| 2010/0320006 | A1 | 12/2010 | Fan et al. |
| 2011/0042149 | A1 | 2/2011 | Scott et al. |
| 2011/0088950 | A1 | 4/2011 | Scott et al. |
| 2011/0120782 | A1 | 5/2011 | Cooley et al. |
| 2011/0171414 | A1 | 7/2011 | Sreshta et al. |
| 2011/0174549 | A1 | 7/2011 | Dolan et al. |
| 2011/0212303 | A1 | 9/2011 | Fuller et al. |
| 2011/0259642 | A1 | 10/2011 | DiGiovanni |
| 2011/0259648 | A1 | 10/2011 | Sani |
| 2011/0266059 | A1 | 11/2011 | DiGiovanni et al. |
| 2012/0037431 | A1 | 2/2012 | DiGiovanni et al. |
| 2012/0080239 | A1 | 4/2012 | Lyons et al. |
| 2012/0097457 | A1 | 4/2012 | Setlur et al. |
| 2012/0103700 | A1 | 5/2012 | Lin |
| 2012/0222363 | A1 | 9/2012 | DiGiovanni et al. |
| 2012/0222364 | A1 | 9/2012 | Lyons et al. |
| 2012/0225253 | A1 * | 9/2012 | DiGiovanni ..... E21B 10/5735 428/161 |
| 2012/0225277 | A1 | 9/2012 | Scott et al. |
| 2012/0292117 | A1 * | 11/2012 | John ..... E21B 10/00 175/428 |
| 2013/0068534 | A1 | 3/2013 | DiGiovanni et al. |
| 2013/0068537 | A1 | 3/2013 | DiGiovanni |
| 2013/0068538 | A1 | 3/2013 | DiGiovanni |
| 2013/0092454 | A1 | 4/2013 | Scott et al. |
| 2013/0292184 | A1 | 11/2013 | Weaver |
| 2014/0060937 | A1 | 3/2014 | Konovalov et al. |
| 2014/0069726 | A1 | 3/2014 | Mumma et al. |
| 2014/0134403 | A1 | 5/2014 | Gledhill |
| 2014/0166371 | A1 | 6/2014 | Whittaker |
| 2015/0021100 | A1 | 1/2015 | Cheng |
| 2015/0129321 | A1 | 5/2015 | Sani |
| 2015/0259986 | A1 | 9/2015 | Stookey |
| 2015/0266163 | A1 | 9/2015 | Stookey et al. |
| 2015/0283618 | A1 | 10/2015 | DiGiovanni et al. |
| 2015/0285007 | A1 | 10/2015 | Stockey |
| 2016/0002982 | A1 | 1/2016 | Mukhopadhyay et al. |
| 2016/0230471 | A1 | 8/2016 | Gonzalez et al. |
| 2016/0318808 | A1 | 11/2016 | Kasonde et al. |
| 2016/0325404 | A1 | 11/2016 | Long et al. |
| 2016/0326809 | A1 | 11/2016 | Long et al. |
| 2016/0339561 | A1 | 11/2016 | Vail |

FOREIGN PATENT DOCUMENTS

| | | | |
|---|---|---|---|
| CA | 2566597 | C | 11/2005 |
| EP | 1750876 | B1 | 7/2011 |
| WO | 2005110648 | A2 | 11/2005 |
| WO | 2009024752 | A2 | 2/2009 |
| WO | 2012145586 | A1 | 10/2012 |

OTHER PUBLICATIONS

Scott et al., U.S. Appl. No. 13/783,118, entitled Cutting Elements Leached to Different Depths Located in Different Regions of an Earth-Boring Tool and Related Methods, filed Mar. 1, 2013.

Stockey et al., U.S. Appl. No. 14/329,380, entitled Cutting Elements Comprising Partially Leached Polycrystalline Material, Tools Comprising Such Cutting Elements, and Methods of Forming Wellbores Using Such Cutting Elements, filed Jul. 11, 2014.

Stockey, David A., U.S. Appl. No. 14/215,786, entitled Cutting Elements Having Non-Planar Cutting Faces With Selectively Leached Regions, Earth-Boring Tools Including Such Cutting Elements, and Related Methods, filed Mar. 17, 2014.

Underwood, Ervin E., Quantitative Stereology, Addison-Wesley Publishing Company, Inc., 1970, 20 pages.

* cited by examiner

CUTTING ELEMENTS HAVING A NON-UNIFORM ANNULUS LEACH DEPTH, EARTH-BORING TOOLS INCLUDING SUCH CUTTING ELEMENTS, AND RELATED METHODS

CROSS-REFERENCE TO RELATED APPLICATION

This application is a continuation of U.S. patent application Ser. No. 14/248,008, filed Apr. 8, 2014, issued as U.S. Pat. No. 9,714,545 on Jul. 25, 2017, the disclosure of which is hereby incorporated herein in its entirety by this reference.

TECHNICAL FIELD

Embodiments of the present disclosure relate to polycrystalline diamond compact (PDC) cutting elements for use in earth-boring tools having one or more regions in which metal solvent catalyst is present within the interstitial spaces between diamond grains in the polycrystalline diamond, and one or more regions in which no metal solvent catalyst is present within the interstitial spaces between diamond grains in the polycrystalline diamond.

BACKGROUND

Earth boring tools for forming wellbores in subterranean earth formations generally include a plurality of cutting elements secured to a body. For example, fixed cutter earth boring rotary drill bits (also referred to as "drag bits") include a plurality of cutting elements that are fixedly attached to a bit body of the drill bit. Similarly, roller cone earth boring rotary drill bits may include cones that are mounted on bearing pins extending from legs of a bit body such that each cone is capable of rotating about the bearing pin on which it is mounted. A plurality of cutting elements may be mounted to each cone of the drill bit.

The cutting elements used in such earth boring tools often include polycrystalline diamond compact (often referred to as "PDC") cutting elements, which are cutting elements that include cutting faces of a polycrystalline diamond material. Polycrystalline diamond material is material that includes inter bonded grains or crystals of diamond material. In other words, polycrystalline diamond material includes direct, inter granular bonds between the grains or crystals of diamond material. The terms "grain" and "crystal" are used synonymously and interchangeably herein.

Polycrystalline diamond compact cutting elements are formed by sintering and bonding together relatively small diamond grains under conditions of high temperature and high pressure in the presence of a catalyst (such as, for example, cobalt, iron, nickel, or alloys and mixtures thereof) to form a layer or "table" of polycrystalline diamond material on a cutting element substrate. These processes are often referred to as high temperature/high pressure (or "HTHP") processes. The cutting element substrate may comprise a cermet material (i.e., a ceramic metal composite material) such as, for example, cobalt cemented tungsten carbide. In such instances, the cobalt (or other catalyst material) in the cutting element substrate may be swept into the diamond grains during sintering and serve as the catalyst material for forming the inter granular diamond to diamond bonds between, and the resulting diamond table from, the diamond grains. In other methods, powdered catalyst material may be mixed with the diamond grains prior to sintering the grains together in a HTHP process.

Upon formation of a diamond table using a HTHP process, catalyst material may remain in interstitial spaces between the grains of diamond in the resulting polycrystalline diamond table. The presence of the catalyst material in the diamond table may contribute to thermal damage in the diamond table when the cutting element is heated during use, due to friction at the contact point between the cutting element and the formation.

Polycrystalline diamond compact cutting elements in which the catalyst material remains in the diamond table are generally thermally stable up to a temperature of about seven hundred and fifty degrees Celsius (750° C.), although internal stress within the cutting element may begin to develop at temperatures exceeding about four hundred degrees Celsius (400° C.) due to a phase change that occurs in cobalt at that temperature (a change from the "beta" phase to the "alpha" phase). Also beginning at about four hundred degrees Celsius (400° C.), there is an internal stress component that arises due to differences in the thermal expansion of the diamond grains and the catalyst metal at the grain boundaries. This difference in thermal expansion may result in relatively large tensile stresses at the interface between the diamond grains, and contributes to thermal degradation of the microstructure when polycrystalline diamond compact cutting elements are used in service. Differences in the thermal expansion between the diamond table and the cutting element substrate to which it is bonded further exacerbate the stresses in the polycrystalline diamond compact. This differential in thermal expansion may result in relatively large compressive and/or tensile stresses at the interface between the diamond table and the substrate that eventually lead to the deterioration of the diamond table, cause the diamond table to delaminate from the substrate, or result in the general ineffectiveness of the cutting element.

Furthermore, at temperatures at or above about seven hundred and fifty degrees Celsius (750° C.), some of the diamond crystals within the diamond table may react with the catalyst material causing the diamond crystals to undergo a chemical breakdown or conversion to another allotrope of carbon. For example, the diamond crystals may graphitize at the diamond crystal boundaries, which may substantially weaken the diamond table. Also, at extremely high temperatures, in addition to graphite, some of the diamond crystals may be converted to carbon monoxide and carbon dioxide.

In order to reduce the problems associated with differences in thermal expansion and chemical breakdown of the diamond crystals in polycrystalline diamond cutting elements, so called "thermally stable" polycrystalline diamond compacts (which are also known as thermally stable products, or "TSPs") have been developed. Such a thermally stable polycrystalline diamond compact may be formed by leaching the catalyst material (e.g., cobalt) out from interstitial spaces between the inter bonded diamond crystals in the diamond table using, for example, an acid or combination of acids (e.g., aqua regia). A substantial amount of the catalyst material may be removed from the diamond table, or catalyst material may be removed from only a portion thereof. Thermally stable polycrystalline diamond compacts in which substantially all catalyst material has been leached out from the diamond table have been reported to be thermally stable up to temperatures of about twelve hundred degrees Celsius (1,200° C.). It has also been reported, however, that such fully leached diamond tables are relatively more brittle and vulnerable to shear, compressive, and tensile stresses than are non-leached diamond tables. In addition, it is difficult to secure a completely leached diamond table to a supporting substrate. In an effort to provide cutting elements having diamond tables that are more thermally stable relative to non-leached diamond tables, but that are also relatively less brittle and vulnerable to shear, compressive, and tensile stresses relative to fully leached diamond tables, cutting elements have been provided that include a diamond table in which the catalyst material has been leached from a portion or portions of the diamond table. For example, it is known to leach catalyst material from the cutting face, from the side of the diamond table, or both, to a desired depth within the diamond table, but without leaching all of the catalyst material out from the diamond table.

BRIEF SUMMARY

In some embodiments, the present disclosure includes a polycrystalline diamond compact (PDC) cutting element having a substrate and a volume of polycrystalline diamond on the substrate. The volume of polycrystalline diamond has a front cutting face, a lateral side surface, and a cutting edge defined between the front cutting face and the lateral side surface. A first region of the volume of polycrystalline diamond adjacent at least a portion of an interface between the volume of polycrystalline diamond and the substrate includes catalyst material in interstitial spaces between inter-bonded diamond grains of the polycrystalline diamond. An annular second region of the volume of polycrystalline diamond adjacent at least a portion of the lateral side surface of the volume of polycrystalline diamond is at least substantially free of the catalyst material. An inner boundary of the annular second region remote from the lateral side surface of the volume of polycrystalline diamond defines at least a portion of an interface between the first region and the annular second region of the volume of polycrystalline diamond. The interface has a non-linear profile in a plane extending through the PDC cutting element along a longitudinal axis of the cutting element.

Additional embodiments of the disclosure include an earth-boring tool including such a PDC cutting element. For example, an earth-boring tool may include a body, and at least one such PDC cutting element secured to the body.

In additional embodiments, the present disclosure includes methods of fabricating a PDC cutting element. A volume of polycrystalline diamond may be formed that has a front cutting face, a lateral side surface, and a cutting edge defined between the front cutting face and the lateral side surface. The volume of polycrystalline diamond may be formed or otherwise provided on a substrate. The volume of polycrystalline diamond may be configured (i) such that the volume of polycrystalline diamond includes a first region adjacent at least a portion of an interface between the volume of polycrystalline diamond and the substrate, the first region having catalyst material in interstitial spaces between inter-bonded diamond grains of the polycrystalline diamond, (ii) such that the volume of polycrystalline diamond further includes an annular second region adjacent at least a portion of the lateral side surface of the volume of polycrystalline diamond, the annular second region being at least substantially free of the catalyst material, and (iii) such that an inner boundary of the second annular region remote from the lateral side surface of the volume of polycrystalline diamond defines at least a portion of an interface between the first region and the annular second region of the volume of polycrystalline diamond, the interface having a non-linear profile in a plane extending through the PDC cutting element along a longitudinal axis of the cutting element.

BRIEF DESCRIPTION OF THE SEVERAL VIEWS OF THE DRAWINGS

While the specification concludes with claims particularly pointing out and distinctly claiming what are regarded as embodiments of the present invention, various features and advantages of disclosed embodiments may be more readily ascertained from the following description when read with reference to the accompanying drawings, in which:

DETAILED DESCRIPTION

The illustrations presented herein are not actual views of any particular material, cutting element, or earth-boring tool, but are merely idealized representations employed to describe embodiments of the present disclosure.

Figure 1:
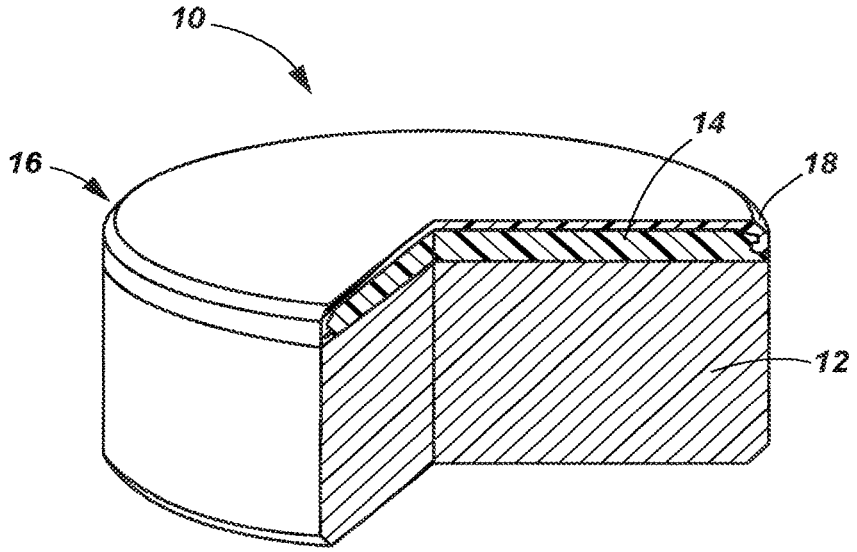
FIG. 1 is a partially cut-away perspective view of a PDC cutting element.
Figure 2:
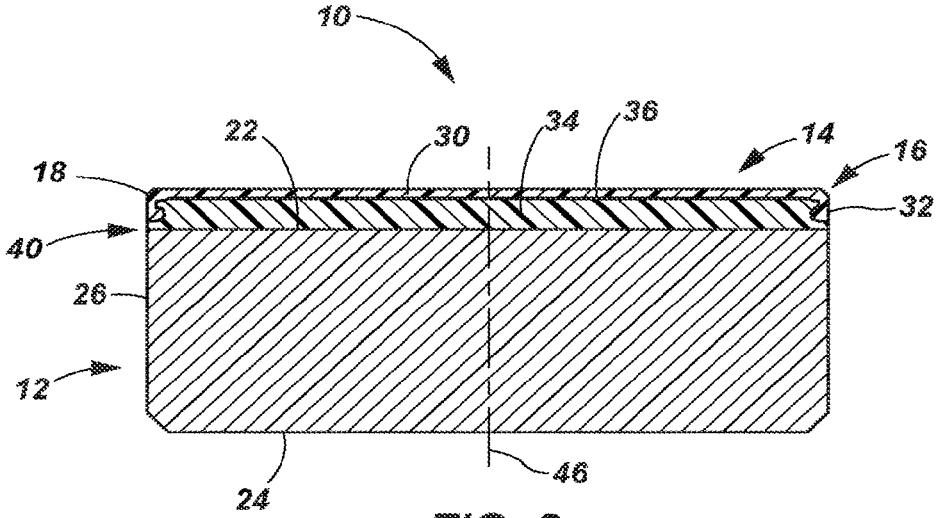
FIG. 2 is a cross-sectional side view of the PDC cutting element of FIG. 1.

FIG. 1 is a partially cut-away perspective view of a polycrystalline diamond compact (PDC) cutting element 10. The cutting element 10 includes a cutting element substrate 12, and a volume of polycrystalline diamond 14 on the substrate 12. The volume of polycrystalline diamond 14 may be formed on the cutting element substrate 12, or the volume of polycrystalline diamond 14 and the substrate 12 may be separately formed and subsequently attached together. FIG. 2 is a cross-sectional side view of the cutting element 10 shown in FIG. 1. As shown in FIG. 2, the volume of polycrystalline diamond 14 may have a chamfered cutting edge 16. The chamfered cutting edge 16 of the cutting element 10 has a single chamfer surface 18, although the chamfered cutting edge 16 also may have additional chamfer surfaces, and such chamfer surfaces may be oriented at any of various chamfer angles, as known in the art.

The cutting element substrate 12 may have a generally cylindrical shape, as shown in FIGS. 1 and 2. Referring to FIG. 2, the cutting element substrate 12 may have an at least substantially planar first end surface 22, an at least substantially planar second end surface 24, and a generally cylindrical lateral side surface 26 extending between the first end surface 22 and the second end surface 24.

Although the end surface 22 shown in FIG. 2 is at least substantially planar, it is well known in the art to employ non-planar interface geometries between substrates and diamond tables formed thereon, and additional embodiments of the present disclosure may employ such non-planar interface geometries at the interface between the substrate 12 and the volume of polycrystalline diamond 14. Additionally, although cutting element substrates commonly have a cylindrical shape, like the cutting element substrate 12, other shapes of cutting element substrates are also known in the art, and embodiments of the present invention include cutting elements having shapes other than a generally cylindrical shape.

The cutting element substrate 12 may be formed from a material that is relatively hard and resistant to wear. For example, the cutting element substrate 12 may be formed from and include a ceramic-metal composite material (which are often referred to as "cermet" materials). The cutting element substrate 12 may include a cemented carbide material, such as a cemented tungsten carbide material, in which tungsten carbide particles are cemented together in a metallic binder material. The metallic binder material may include, for example, cobalt, nickel, iron, or alloys and mixtures thereof.

With continued reference to FIG. 2, the volume of polycrystalline diamond 14 may be disposed on or over the first end surface 22 of the cutting element substrate 12. The volume of polycrystalline diamond 14 may comprise grains or crystals of diamond that are bonded directly together by inter-granular diamond-to-diamond bonds to form the polycrystalline diamond. Interstitial regions or spaces between the diamond grains may be filled with additional materials, or may be air-filled voids, as discussed below.

The volume of polycrystalline diamond 14 is primarily comprised of diamond grains. In other words, diamond grains may comprise at least about seventy percent (70%) by volume of the volume of polycrystalline diamond 14. In additional embodiments, the diamond grains may comprise at least about eighty percent (80%) by volume of the volume of polycrystalline diamond 14, and in yet further embodiments, the diamond grains may comprise at least about ninety percent (90%) by volume of the volume of polycrystalline diamond 14.

The volume of polycrystalline diamond 14 has a front cutting face 30, a lateral side surface 32. The cutting edge 16 is defined between the front cutting face 30 and the lateral side surface 32 of the volume of polycrystalline diamond 14.

A first region 34 of the volume of polycrystalline diamond 14 is disposed adjacent at least a portion of an interface 40 between the volume of polycrystalline diamond 14 and the substrate 12. The first region 34 includes catalyst material 52 (FIG. 3) in interstitial spaces between inter-bonded diamond grains 50 (FIG. 3) of the polycrystalline diamond 14, as discussed in further detail below in relation to FIG. 3.

An annular second region 36 of the volume of polycrystalline diamond 14 is disposed adjacent at least a portion of the lateral side surface 32 of the volume of polycrystalline diamond 14. The second region 36 is at least substantially free of the catalyst material 52 (FIG. 3), as discussed in further detail below in relation to FIG. 4.

Figure 3:
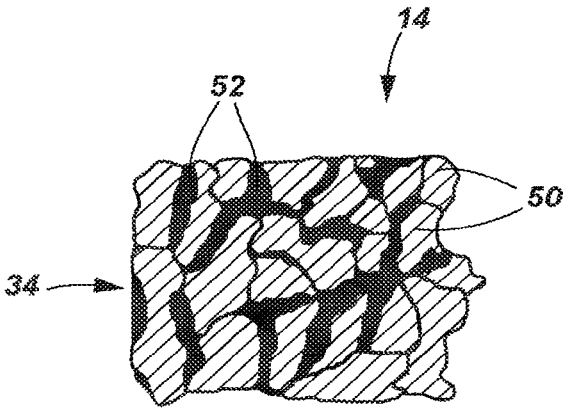
FIG. 3 is an enlarged view illustrating how a microstructure of an un-leached first volume of the polycrystalline diamond of the PDC cutting element of FIGS. 1 and 2 may appear under magnification.

FIG. 3 is an enlarged view illustrating how a microstructure of the polycrystalline diamond 14 in the first region 34 thereof may appear under magnification. As shown in FIG. 3, the first region 34 of the polycrystalline diamond 14 includes diamond crystals or grains 50 that are bonded directly together by inter-granular diamond-to-diamond bonds to form the polycrystalline diamond 14. A catalyst material 52 (the shaded regions between the diamond crystals or grains 50) is disposed in interstitial regions or spaces between the diamond grains 50. The catalyst material 52 may comprise, for example, a metal solvent catalyst material used in the formation of the inter-granular diamond-to-diamond bonds between the diamond grains 50.

As used herein, the term "catalyst material" refers to any material that is capable of catalyzing the formation of inter-granular diamond-to-diamond bonds in a diamond grit or powder during an HTHP process in the manufacture of polycrystalline diamond. By way of example, the catalyst material 52 may include cobalt, iron, nickel, or an alloy or mixture thereof. The catalyst material 52 may comprise other than elements from Group VIIIA of the Periodic Table of the Elements, including alloys or mixtures thereof.

Figure 4:
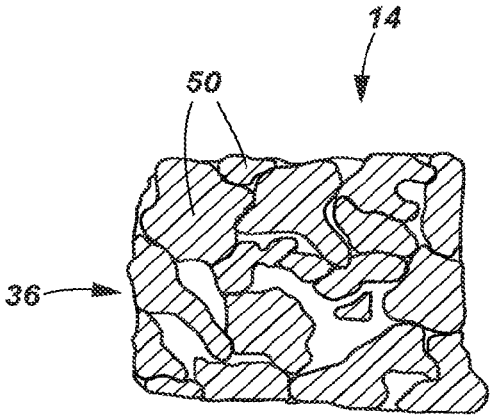
FIG. 4 is an enlarged view illustrating how a microstructure of a leached second volume of the polycrystalline diamond of the PDC cutting element of FIGS. 1 and 2 may appear under magnification.

FIG. 4 is an enlarged view like that of FIG. 3 illustrating how a microstructure of the polycrystalline diamond 14 in the second region 36 thereof may appear under magnification. As shown in FIG. 4, the second region 36 of the polycrystalline diamond 14 also includes diamond crystals or grains 50 that are bonded directly together by inter-granular diamond-to-diamond bonds to form the polycrystalline diamond 14. In the second region 36, however, the interstitial spaces between the diamond crystals or grains 50 may comprise voids (i.e., they may be filled with gas, such as air), or they may comprise a material that is not a catalyst material.

The first region 34 of the volume of polycrystalline diamond 14 may comprise what is often referred to in the art as an "un-leached" region, and the second region 36 of the volume of polycrystalline diamond 14 may comprise what is often referred to in the art as a "leached" region. Embodiments of PDC cutting elements as described herein, such as the cutting element 10, may be formed by using a leaching process to remove the catalyst material 52 from the second region 36 without removing catalyst material 52 from the first region 34, as described below with reference to FIGS. 8 through 10. In other embodiments, however, other non-leaching methods may be used to remove the catalyst material 52 from the second region 36 of the polycrystalline diamond 14, or the volume of polycrystalline diamond 14 may simply be formed in a manner that results in the presence of catalyst material 52 within the first region 34 and an absence of catalyst material 52 in the second region 36, such that removal of catalyst material 52 from the second region 36 is not needed or required. Thus, as used herein, the term "leached," when used in relation to a region of a volume of polycrystalline diamond, means a region that does not include catalyst material in interstitial spaces between inter-bonded diamond grains, regardless of whether or not catalyst material was removed from that region (by a leaching process or any other removal process). Similarly, as used herein, the term "un-leached," when used in relation to a region of a volume of polycrystalline diamond, means a region that includes catalyst material in interstitial spaces between inter-bonded diamond grains (regardless of whether or not catalyst material was leached or otherwise removed from other regions of the polycrystalline diamond).

Figure 5:
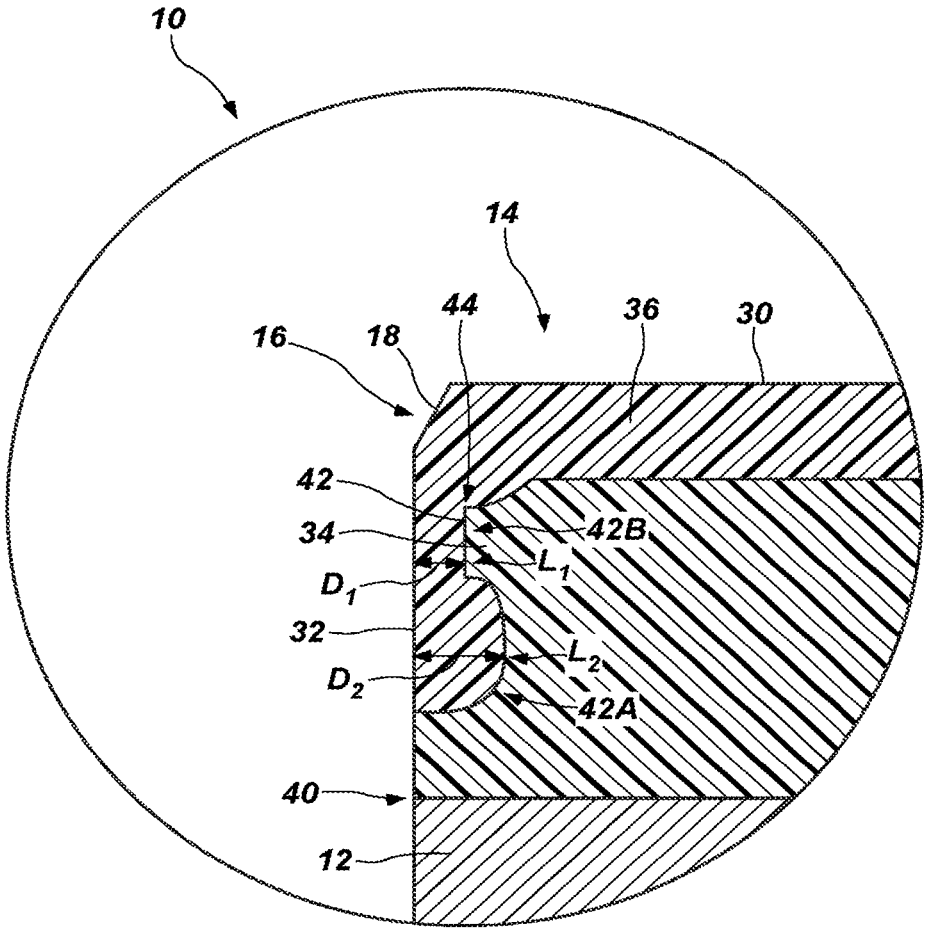
FIG. 5 is an enlarged view of a portion of FIG. 2 illustrating an interface between an un-leached volume and a leached volume of the polycrystalline diamond of the PDC cutting element of FIGS. 1 and 2.

FIG. 5 is an enlarged view of a portion of FIG. 2, and illustrates a portion of the volume of polycrystalline diamond 14 proximate the cutting edge 16. As shown in FIG. 5, an inner boundary 42 of the second annular region 36 remote from the lateral side surface 32 of the volume of polycrystalline diamond 14 defines at least a portion of an interface 44 between the first region 34 and the annular second region 36 of the volume of polycrystalline diamond 14. The interface 44 has a non-linear profile in a plane extending through the PDC cutting element 10 along a longitudinal axis 46 of the PDC cutting element 10 (e.g., the plane of the cross-section of FIG. 2.

Figure 5A:
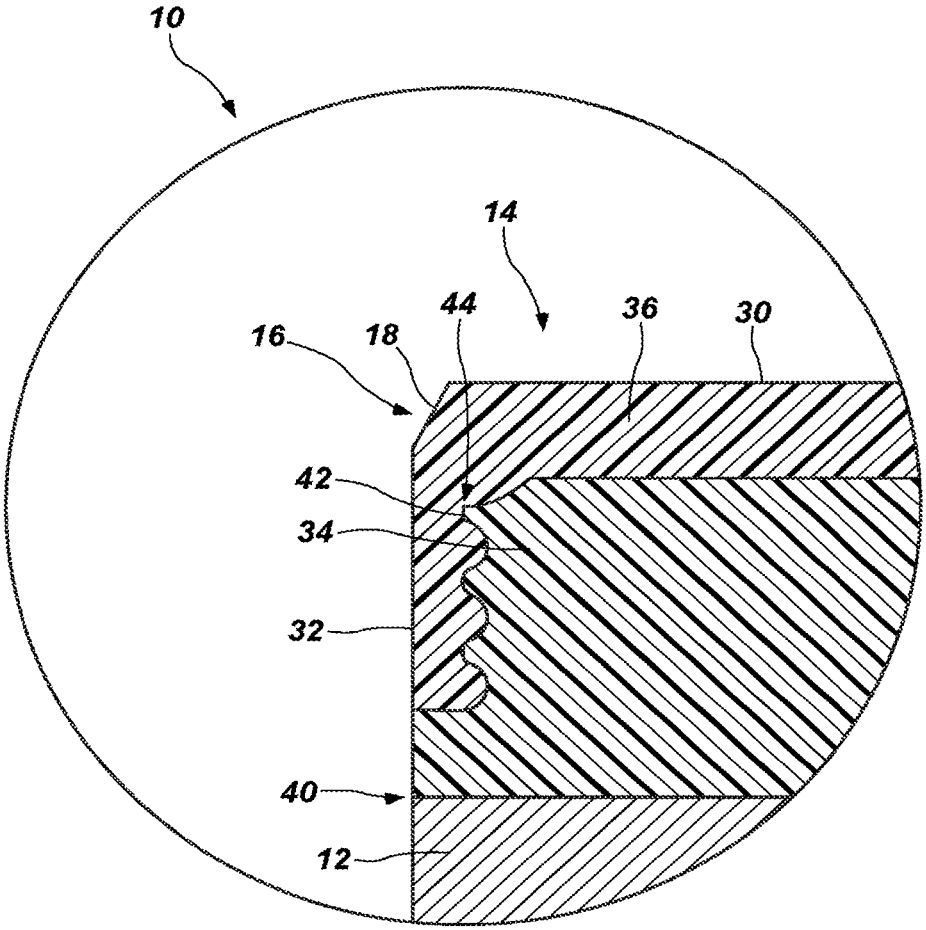
FIG. 5A is similar to FIG. 5 and illustrates an additional embodiment having an undulating interface between an un-leached volume and an annular leached volume of the polycrystalline diamond.

As shown in FIG. 5, the non-linear profile of the interface 44 may have at least one curved section 42A. In some embodiments, the non-linear profile of the interface 44 may have at least one curved section 42A and at least one linear section 42B. In such embodiments, the curved section 42A may be located closer to the interface 40 between the substrate 12 and the volume of polycrystalline diamond 14 relative to the linear section 42B. In yet further embodiments, the non-linear profile of the interface 44 may have a plurality of curved sections, such that the non-linear profile of the interface 44 has an undulating (e.g., sinusoidal) shape in the vertical direction, as shown in FIG. 5A.

The non-linear profile of the interface 44 between the first region 34 and the second region 36 of the polycrystalline diamond 14 may be disposed a first distance $D_1$ from the lateral side surface 32 of the volume of polycrystalline diamond 14 at a first location $L_1$ along the profile of the interface 44. At a second location $L_2$ along the profile of the interface 44 closer to the interface 40 between the substrate 12 and the volume of polycrystalline diamond 14, the non-linear profile of the interface 44 may be disposed a second distance $D_2$ from the lateral side surface 32 of the volume of polycrystalline diamond 14, the second distance $D_2$ being greater than the first distance $D_1$.

In the embodiment shown in FIGS. 1 and 2, the second region 36 of the polycrystalline diamond 14 comprises a continuous region of the polycrystalline diamond 14 that extends into the volume of polycrystalline diamond 14 across the entire area of the front cutting face 30, as well as into the volume of polycrystalline diamond 14 from a portion of the lateral side surface 32 of the volume of polycrystalline diamond 14 that extends circumferentially around the entirety of the volume of polycrystalline diamond 14. The annular portion of the second region 36 of the polycrystalline diamond 14 has a thicker region (extending radially a deeper depth into the polycrystalline diamond 14 toward the longitudinal axis 46) located closer to the interface 40 between the substrate 12 and the polycrystalline diamond 14, and a thinner region (extending radially a shallower depth into the polycrystalline diamond 14 toward the longitudinal axis 46) located closer to the cutting edge 16 and the front cutting face 30 of the volume of polycrystalline diamond 14.

In the embodiment shown in FIGS. 1 through 5, the interface between the un-leached first region 34 and the portion of the second region 36 extending across the front cutting face 30 of the volume of polycrystalline diamond 14 has a planar profile. In additional embodiments, however, the interface between the un-leached first region 34 and the portion of the second region 36 extending across the front cutting face 30 of the volume of polycrystalline diamond 14 may have a non-planar profile, such as any of the profiles disclosed in U.S. patent application Ser. No. 14/248,068, filed Apr. 8, 2014, now U.S. Pat. No. 9,605,488, issued Mar. 28, 2017, and titled "CUTTING ELEMENTS INCLUDING UNDULATING BOUNDARIES BETWEEN CATALYST-CONTAINING AND CATALYST-FREE REGIONS OF POLYCRYSTALLINE SUPERABRASIVE MATERIALS AND RELATED EARTH-BORING TOOLS AND METHODS," the entire disclosure of which is incorporated herein in its entirety by this reference.

Figure 6:
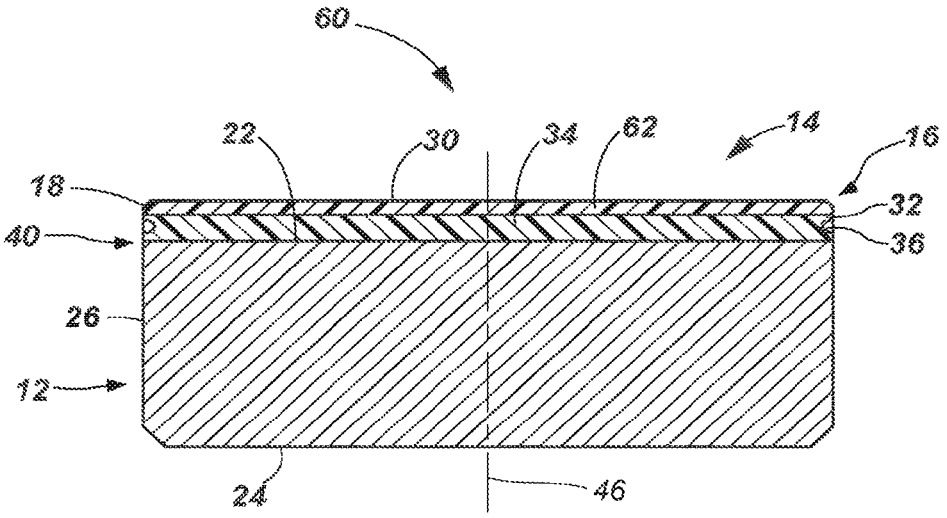
FIG. 6 is a cross-sectional view like that of FIG. 2 illustrating another embodiment of a PDC cutting element.
Figure 7:
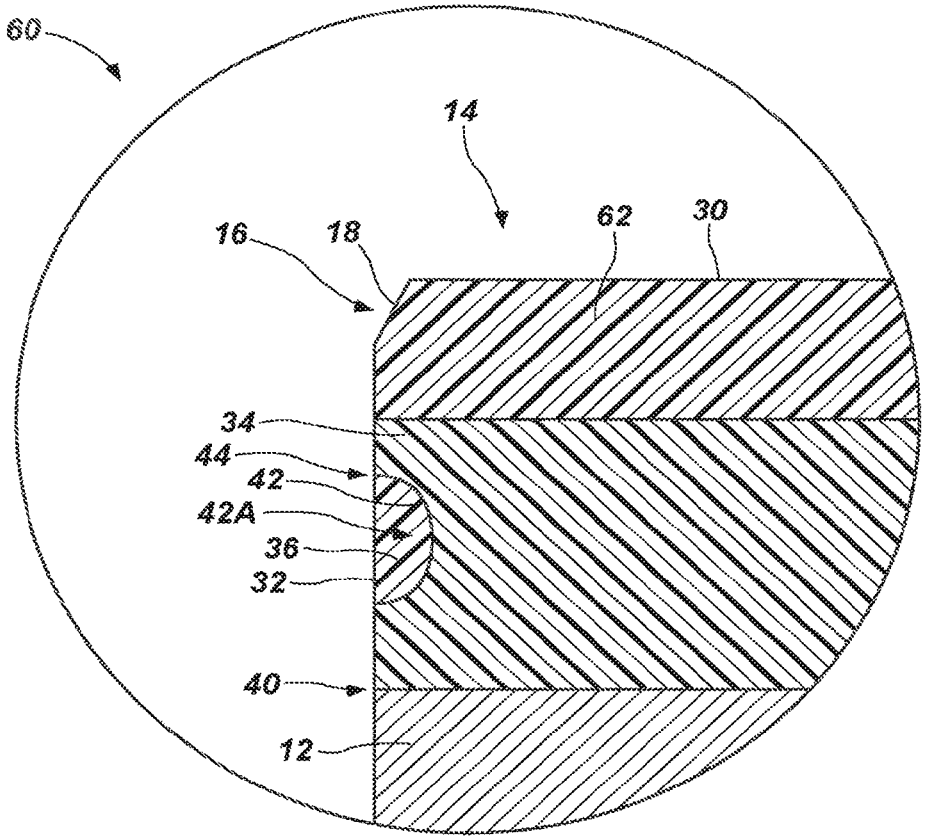
FIG. 7 is an enlarged view of a portion of FIG. 6 illustrating an interface between an un-leached volume and leached volumes of the polycrystalline diamond of the PDC cutting element of FIG. 6.

FIGS. 6 and 7 illustrate another embodiment of a PDC cutting element 60 of the present disclosure. The PDC cutting element 60 is generally similar to the PDC cutting element 10 of FIGS. 1 through 5, and includes a cutting element substrate 12, and a volume of polycrystalline diamond 14 on the substrate 12, each of which may be as previously described. The volume of polycrystalline diamond 14 may have a chamfered cutting edge 16 having one or more chamfer surfaces 18. As previously described, the volume of polycrystalline diamond 14 has a front cutting face 30 and a lateral side surface 32. An un-leached first region 34 of the volume of polycrystalline diamond 14 is disposed adjacent at least a portion of an interface 40 between the volume of polycrystalline diamond 14 and the substrate 12. A leached annular second region 36 of the volume of polycrystalline diamond 14 is disposed adjacent at least a portion of the lateral side surface 32 of the volume of polycrystalline diamond 14.

As shown in FIG. 7, an inner boundary 42 of the second annular region 36 remote from the lateral side surface 32 of the volume of polycrystalline diamond 14 defines at least a portion of an interface 44 between the first region 34 and the annular second region 36 of the volume of polycrystalline diamond 14. Similar to the embodiment of FIGS. 1 through 5, the interface 44 has a non-linear profile in a plane extending through the PDC cutting element 10 along a longitudinal axis 46 of the PDC cutting element 10 (e.g., the plane of the cross-section of FIGS. 6 and 7).

In the embodiment of FIGS. 6 and 7, the non-linear profile of the interface 44 has a single, continuous curved section 42A, and does not include any linear sections. The annular second region 36 of the polycrystalline diamond 14 comprises a continuous region of the polycrystalline diamond 14 that extends into the volume of polycrystalline diamond 14 from a portion of the lateral side surface 32 of the volume of polycrystalline diamond 14, and that extends circumferentially around the entirety of the volume of polycrystalline diamond 14. The annular second region 36, however, does not extend to the front cutting face 30 of the volume of polycrystalline diamond 14. The volume of polycrystalline 14 of the PDC cutting element 60 of FIGS. 6 and 7 includes a leached third region 62 adjacent the front cutting face 30 of the volume of polycrystalline diamond 14. The leached third region 62, like the leached annular second region 36, is at least substantially free of catalyst material in interstitial spaces between inter-bonded diamond grains of the polycrystalline diamond 14. Further, as shown in FIGS. 6 and 7, the leached annular second region 36 of the volume of polycrystalline diamond 14 does not contact the leached third region 62 of the volume of polycrystalline diamond 14. The un-leached first region 34 of the polycrystalline diamond 14 extends to the lateral side surface 32 of the polycrystalline diamond 14 between the leached annular second region 36 and the leached third region 62.

In the embodiment shown in FIGS. 6 and 7, the interface between the leached third region 62 and the un-leached first region 34 of the volume of polycrystalline diamond 14 has a planar profile. In additional embodiments, however, the interface between the leached third region 62 and the un-leached first region 34 of the volume of polycrystalline diamond 14 may have a non-planar profile, such as any of the profiles disclosed in the previously-mentioned U.S. patent application Ser. No. 14/248,068, filed Apr. 8, 2014, now U.S. Pat. No. 9,605,488, issued Mar. 28, 2017, and titled "CUTTING ELEMENTS INCLUDING UNDULATING BOUNDARIES BETWEEN CATALYST-CONTAINING AND CATALYST-FREE REGIONS OF POLYCRYSTALLINE SUPERABRASIVE MATERIALS AND RELATED EARTH-BORING TOOLS AND METHODS."

As shown in FIGS. 5 and 7, in some embodiments of PDC cutting elements 10, 60 as described herein, the annular second region 36 of the volume of polycrystalline diamond 14 may not contact the interface 40 between the substrate 12 and the polycrystalline diamond 14. In other embodiments, however, the annular second region 36 of the volume of polycrystalline diamond 14 may extend to and contact the interface 40 between the substrate 12 and the polycrystalline diamond 14.

Embodiments of cutting elements 10, 60 as described herein, which have interfaces 44 with non-linear profiles between an un-leached first region 34 and a leached annular second region 36 located along the lateral side surface 32 of the polycrystalline diamond 14, may exhibit improved stress states within the polycrystalline diamond 14 proximate the cutting edges 16 of the cutting elements 10, 60. For example, cracks may form within and/or propagate through polycrystalline diamond 14 more easily when the polycrystalline diamond 14 is in a state of tensile stress, compared to when the polycrystalline diamond 14 is not stressed or in a state of compressive stress. It is further believed that cracks may be less likely to form within and/or propagate through polycrystalline diamond 14 when the polycrystalline diamond 14 is in a state of compressive stress, compared to when the polycrystalline diamond 14 is not stressed or in a state of tensile stress. The configurations of the leached second regions 36 in the annulus regions of the polycrystalline diamond 14 of the cutting elements 10, 60 as described herein are believed to provide improved stress states within the polycrystalline diamond 14 proximate the cutting edges 16 of the polycrystalline diamond 14, which may lead to reduced fracture and spalling, and increased useable lifetimes relative to previously known cutting elements.

For example, referring to FIG. 5, the annular second region 36 of the volume of polycrystalline diamond 14 of the PDC cutting element 10 may be in a state of compressive stress, at least proximate the cutting edge 16, at ambient conditions after manufacture of the cutting element 10 and prior to use of the cutting element 10. Similarly, referring to FIG. 7, the polycrystalline diamond 14 of the PDC cutting element 60 may be in a state of compressive stress proximate the cutting edge 16 at ambient conditions after manufacture and prior to use of the cutting element 60.

Figure 9:
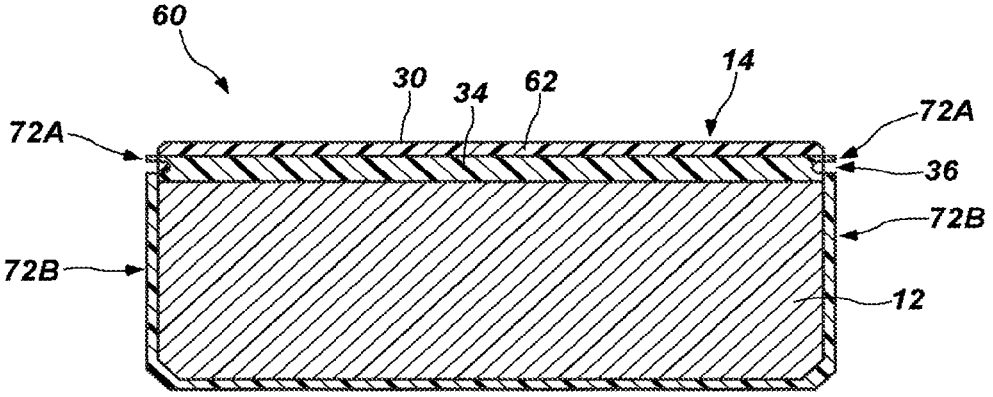
Figure 10:
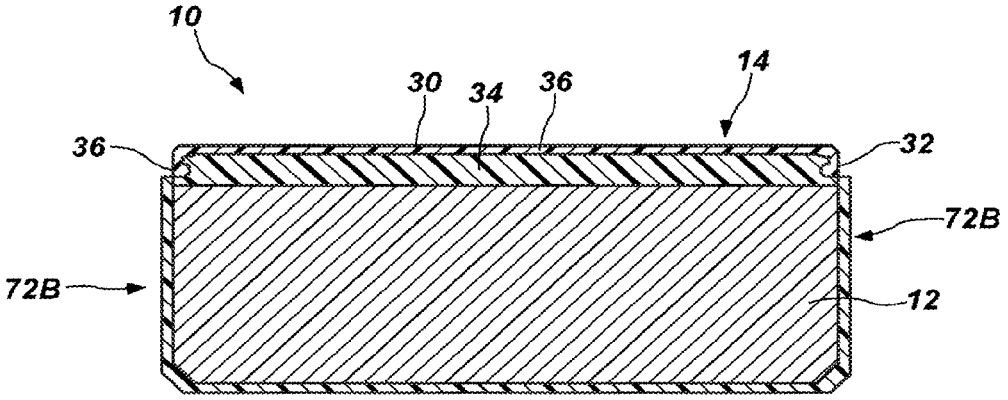

The PDC cutting elements 10, 60 as described herein may be fabricated as described below with reference to FIGS. 8 through 10.

Figure 8:
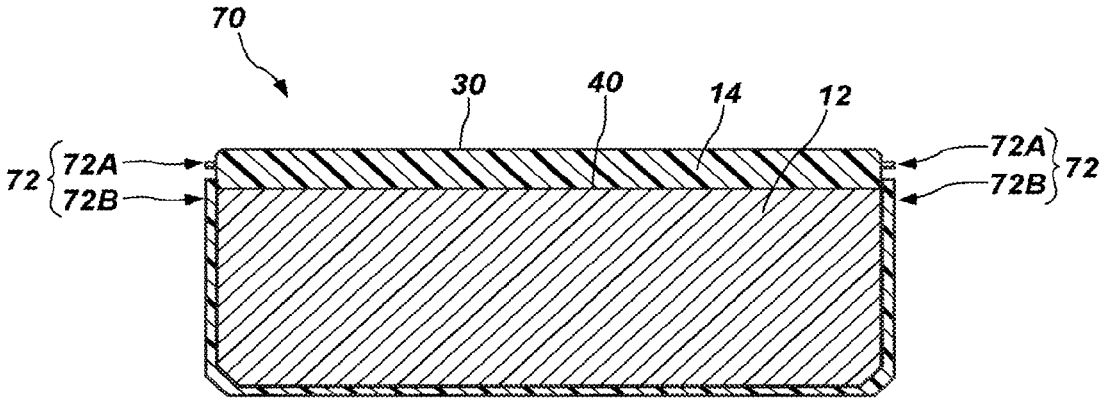
FIGS. 8 through 10 are cross-sectional side views like those of FIGS. 2 and 6 and illustrate methods that may be used to fabricate PDC cutting elements as described herein.

FIG. 8 is a simplified cross-sectional side view similar to that of FIGS. 2 and 6, and illustrates a PDC cutting element 70 including a volume of polycrystalline diamond 14 on a substrate 12. The polycrystalline diamond 14 and the substrate 12 may be as previously described herein, with the exception that the polycrystalline diamond 14 may be initially un-leached, such that the entirety of the polycrystalline diamond 14 includes catalyst material 52 in the interstitial spaces between the inter-bonded diamond grains 50 of the polycrystalline diamond 14. Thus, the entire volume of polycrystalline diamond 14 may initially be like the un-leached first region 34 of the polycrystalline diamond 14 of the PDC cutting element 10 of FIGS. 1 through 5.

As shown in FIG. 8, a mask 72 or other sealing material or structure may be formed or otherwise provided over exterior surfaces of the PDC cutting element 70. For example, the mask 72 may include an annular mask portion 72A that extends circumferentially around and on the lateral side surface 32 (FIG. 5) of the volume of polycrystalline diamond 14. The annular mask portion 72A may not contact the substrate 12, such that exposed surfaces of the volume of polycrystalline diamond 14 are exposed on opposing sides of the annular mask portion 72A. The annular mask portion 72A may not contact the front cutting face 30 of the polycrystalline diamond 14 in some embodiments. In some embodiments, the annular mask portion 72A may comprise an O-ring. In additional embodiments, the annular mask portion 72A may comprise a sealing material or structure other than an O-ring. The mask 72 may include another portion 72B that covers the exterior surfaces of the substrate 12, and may extend over and cover the interface 40 between the substrate 12 and the volume of polycrystalline material 14.

The mask 72 may comprise a layer of material that is impermeable to a leaching agent used to leach catalyst material 52 out from the interstitial spaces between the diamond grains 50 within what will become a leached regions within the volume of polycrystalline diamond 14. As a non-limiting example, the mask 72 may comprise a polymer material, such as an epoxy.

After forming or otherwise providing the mask 72 on the PDC cutting element 70, the polycrystalline diamond 14 then may be immersed in or otherwise exposed to a leaching agent (e.g., an acid, aqua regia, etc.), such that the leaching agent may be allowed to leach and remove the catalyst material 52 (e.g., metal solvent catalyst) out from the interstitial spaces between the diamond grains 50 within the polycrystalline diamond 14 and form a leached annular second region 36 within the polycrystalline diamond 14. Such leaching agents are known in the art. The front cutting face 30 of the volume of polycrystalline diamond 14 also may be exposed to the leaching agent, resulting in the formation of a leached third region 62 in the volume of polycrystalline diamond 14. Thus, as can be seen in FIG. 9, a PDC cutting element 60 as previously described with reference to FIGS. 6 and 7 may be formed upon subjecting the PDC cutting element 70 and the mask 72 of FIG. 8 to the leaching agent. The mask 72 then may be removed at this point and the PDC cutting element 60 may be used on an earth-boring tool.

Alternatively, the annular mask portion 72A may be removed, while leaving the mask portion 72B covering the substrate 12 in place, and the exposed surfaces of the polycrystalline diamond 14 may again be subjected to a leaching agent in a leaching process, which will push the interface(s) between the leached regions and the un-leached region to further depths within the volume of polycrystalline diamond 14. Furthermore, removing the annular mask portion 72A and subjecting the polycrystalline diamond 14 to an additional leaching process may result in the formation of a PDC cutting element 10 as previously described with reference to FIGS. 1 through 5, as shown in FIG. 10. The mask portion 72B then may be removed, and the PDC cutting element 10 may be used on an earth-boring tool.

Embodiments of cutting elements of the present invention, such as the PDC cutting element 10 previously described herein with reference to FIGS. 1 through 5 (or the PDC cutting element 60 described with reference to FIGS.

6 and 7), may be used to form embodiments of earth-boring tools of the present invention.

Figure 11:
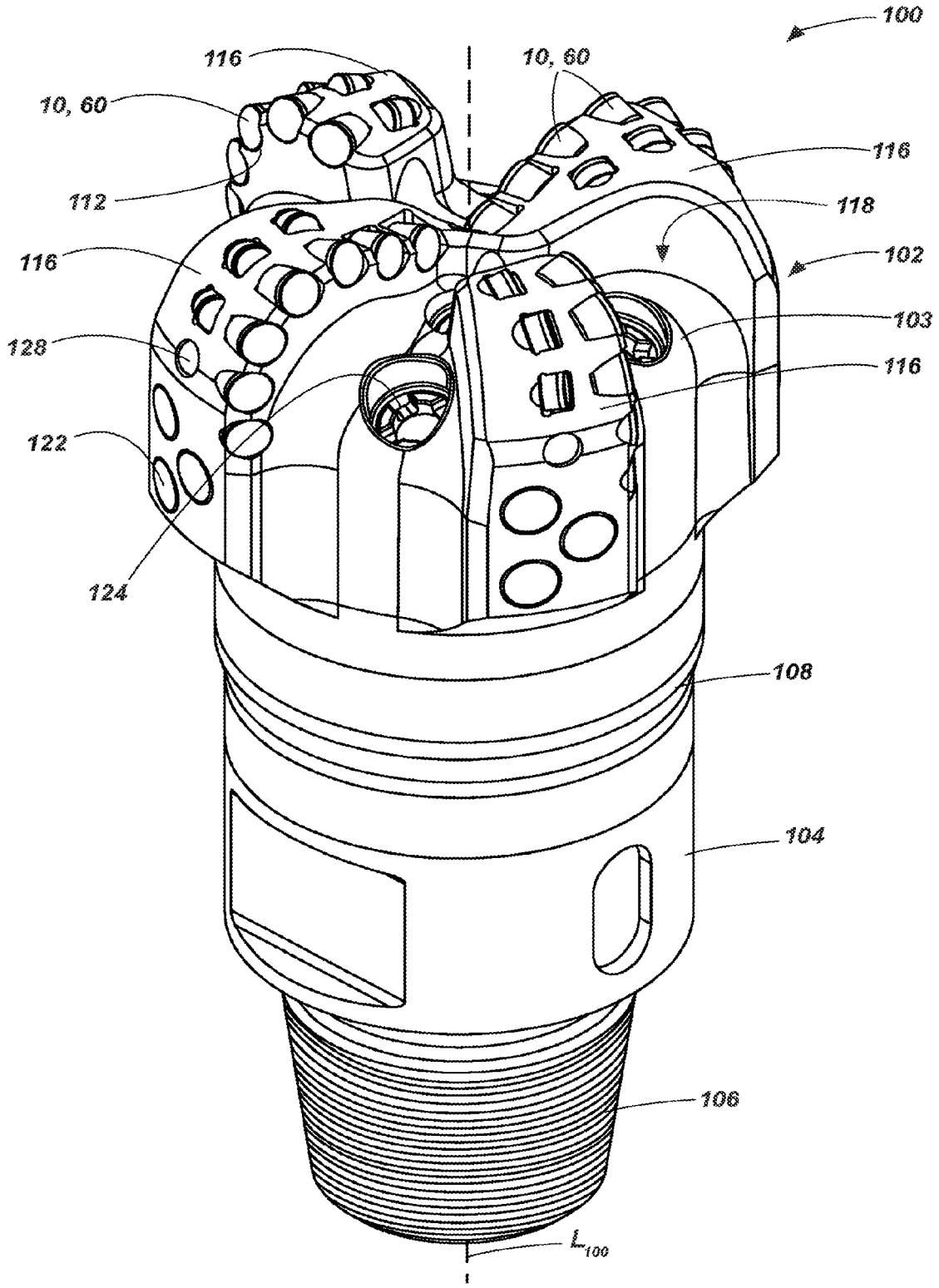
FIG. 11 is a perspective view of an embodiment of an earth-boring tool in the form of a fixed-cutter earth-boring rotary drill bit, which may include a plurality of PDC cutting elements like that shown in FIGS. 1 and 2 or that shown in FIGS. 6 and 7.

FIG. 11 is a perspective view of an embodiment of an earth-boring rotary drill bit 100 of the present invention that includes a plurality of cutting elements 10 like those shown in FIGS. 1 through 5, although, the drill bit 100 may include cutting elements 60 or any other cutting elements according to the present disclosure in additional embodiments. The earth-boring rotary drill bit 100 includes a bit body 102 that is secured to a shank 104 having a threaded connection portion 106 (e.g., an American Petroleum Institute (API) threaded connection portion) for attaching the drill bit 100 to a drill string (not shown). In some embodiments, such as that shown in FIG. 11, the bit body 102 may comprise a particle-matrix composite material, and may be secured to the metal shank 104 using an extension 108. In other embodiments, the bit body 102 may be secured to the shank 104 using a metal blank embedded within the particle-matrix composite bit body 102, or the bit body 102 may be secured directly to the shank 104.

The bit body 102 may include internal fluid passageways (not shown) that extend between the face 103 of the bit body 102 and a longitudinal bore (not shown), which extends through the shank 104, the extension 108, and partially through the bit body 102. Nozzle inserts 124 also may be provided at the face 103 of the bit body 102 within the internal fluid passageways. The bit body 102 may further include a plurality of blades 116 that are separated by junk slots 118. In some embodiments, the bit body 102 may include gage wear plugs 122 and wear knots 128. A plurality of cutting elements 10 as previously disclosed herein, may be mounted on the face 103 of the bit body 102 in cutting element pockets 112 that are located along each of the blades 116. In other embodiments, cutting elements 60 like those shown in FIGS. 6 and 7, or any other embodiment of a PDC cutting element as disclosed herein may be provided in the cutting element pockets 112.

The cutting elements 10 are positioned to cut a subterranean formation being drilled while the drill bit 100 is rotated under weight-on-bit (WOB) in a bore hole about centerline $L_{100}$.

The PDC cutting elements 10, 60 described herein, or any other cutting elements according to the present disclosure, may be used on other types of earth-boring tools. As non-limiting examples, embodiments of cutting elements of the present disclosure also may be used on cones of roller cone drill bits, on reamers, mills, bi-center bits, eccentric bits, coring bits, and so-called "hybrid bits" that include both fixed cutters and rolling cutters.

Additional non-limiting example embodiments of the disclosure are set forth below.

Embodiment 1

A polycrystalline diamond compact (PDC) cutting element, comprising: a substrate; and a volume of polycrystalline diamond on the substrate, the volume of polycrystalline diamond having a front cutting face, a lateral side surface, and a cutting edge defined between the front cutting face and the lateral side surface; wherein a first region of the volume of polycrystalline diamond adjacent at least a portion of an interface between the volume of polycrystalline diamond and the substrate includes catalyst material in interstitial spaces between inter-bonded diamond grains of the polycrystalline diamond; and wherein an annular second region of the volume of polycrystalline diamond adjacent at least a portion of the lateral side surface of the volume of polycrystalline diamond is at least substantially free of the catalyst material; and wherein an inner boundary of the second annular region remote from the lateral side surface of the volume of polycrystalline diamond defines at least a portion of an interface between the first region and the annular second region of the volume of polycrystalline diamond, the interface having a non-linear profile in a plane extending through the PDC cutting element along a longitudinal axis of the cutting element.

Embodiment 2

The PDC cutting element of Embodiment 1, wherein the non-linear profile has at least one curved section.

Embodiment 3

The PDC cutting element of Embodiment 1 or Embodiment 2, wherein the non-linear profile has at least one curved section and at least one linear section, the at least one curved section being closer to an interface between the substrate and the volume of polycrystalline diamond relative to the at least one linear section.

Embodiment 4

The PDC cutting element of any one of Embodiments 1 through 3, wherein the non-linear profile is disposed a first distance from the lateral side surface of the volume of polycrystalline diamond at a first location along the profile, and is disposed a second distance from the lateral side surface of the volume of polycrystalline diamond at a second location along the profile, the second location along the profile being closer to an interface between the substrate and the volume of polycrystalline diamond relative to first location along the profile, the second distance being greater than the first distance.

Embodiment 5

The PDC cutting element of any one of Embodiments 1 through 4, wherein the annular second region of the volume of polycrystalline diamond does not extend to the front cutting face of the volume of polycrystalline diamond.

Embodiment 6

The PDC cutting element of Embodiment 5, wherein a third region of the volume of polycrystalline diamond adjacent the front cutting face of the volume of polycrystalline diamond is at least substantially free of the catalyst material in interstitial spaces between inter-bonded diamond grains of the polycrystalline diamond, and wherein the annular second region of the volume of polycrystalline diamond does not contact the third region of the volume of polycrystalline diamond.

Embodiment 7

The PDC cutting element of Embodiment 6, wherein the first region of the volume of polycrystalline diamond extends to the lateral side surface of the volume of polycrystalline diamond between the annular second region and the third region of the volume of polycrystalline diamond.

Embodiment 8

The PDC cutting element of any one of Embodiments 1 through 7, wherein the annular second region is in a state of compressive stress at ambient conditions after manufacture and prior to use of the PDC cutting element.

Embodiment 9

The PDC cutting element of any one of Embodiments 1 through 8, wherein the annular second region of the volume of polycrystalline diamond does not contact an interface between the volume of polycrystalline diamond and the substrate.

Embodiment 10

An earth-boring tool, comprising: a body; and at least one polycrystalline diamond compact (PDC) cutting element as recited in any one of Embodiments 1 through 9 secured to the body.

Embodiment 11

The earth-boring tool of Embodiment 10, wherein the earth-boring tool comprises at least one of a drill bit, a reamer, and a mill.

Embodiment 12

A method of fabricating a polycrystalline diamond compact (PDC) cutting element, comprising: forming a volume of polycrystalline diamond having a front cutting face, a lateral side surface, and a cutting edge defined between the front cutting face and the lateral side surface; providing the volume of polycrystalline diamond on a substrate; and configuring the volume of polycrystalline diamond (i) such that the volume of polycrystalline diamond includes a first region adjacent at least a portion of an interface between the volume of polycrystalline diamond and the substrate, the first region having catalyst material in interstitial spaces between inter-bonded diamond grains of the polycrystalline diamond, (ii) such that the volume of polycrystalline diamond further includes an annular second region adjacent at least a portion of the lateral side surface of the volume of polycrystalline diamond, the annular second region being at least substantially free of the catalyst material, and (iii) such that an inner boundary of the second annular region remote from the lateral side surface of the volume of polycrystalline diamond defines at least a portion of an interface between the first region and the annular second region of the volume of polycrystalline diamond, the interface having a non-linear profile in a plane extending through the PDC cutting element along a longitudinal axis of the cutting element.

Embodiment 13

The method of Embodiment 12, wherein providing the volume of polycrystalline diamond on the substrate comprises forming the volume of polycrystalline diamond on the substrate.

Embodiment 14

The method of Embodiment 12 or Embodiment 13, wherein configuring the volume of polycrystalline diamond comprises removing the catalyst material from the interstitial spaces between inter-bonded diamond grains of the polycrystalline diamond in the annular second region of the volume of polycrystalline diamond.

Embodiment 15

The method of Embodiment 14, wherein removing the catalyst material comprises leaching the catalyst material out from the interstitial spaces between inter-bonded diamond grains of the polycrystalline diamond in the annular second region of the volume of polycrystalline diamond.

Embodiment 16

The method of Embodiment 15, wherein leaching the catalyst material out from the interstitial spaces between inter-bonded diamond grains of the polycrystalline diamond in the annular second region of the volume of polycrystalline diamond comprises: providing an annular mask extending circumferentially around and on the lateral side surface of the volume of polycrystalline diamond; and exposing the volume of polycrystalline diamond to a leaching agent to leach the catalyst material out from the interstitial spaces between inter-bonded diamond grains of the polycrystalline diamond in the annular second region of the volume of polycrystalline diamond.

Embodiment 17

The method of Embodiment 16, further comprising: configuring the annular mask such that the annular mask does not contact the substrate; and contacting regions of the lateral side surface of the volume of polycrystalline diamond on opposing sides of the annular mask to the leaching agent.

Embodiment 18

The method of Embodiment 17, further comprising: removing the annular mask from the volume of polycrystalline diamond; and contacting at least one region of the lateral side surface previously masked from the leaching agent by the annular mask to a leaching agent to leach catalyst material out from interstitial spaces between inter-bonded diamond grains of the polycrystalline diamond in the at least one region of the lateral side surface previously masked from the leaching agent by the annular mask.

Embodiment 19

The method of any one of Embodiments 12 through 18, wherein configuring the volume of polycrystalline diamond further comprises configuring the volume of polycrystalline diamond (iv) such that the annular second region of the volume of polycrystalline diamond does not extend to the front cutting face of the volume of polycrystalline diamond.

Embodiment 20

The method of any one of Embodiments 12 through 19, wherein configuring the volume of polycrystalline diamond further comprises configuring the volume of polycrystalline diamond (v) such that the volume of polycrystalline diamond includes a third region adjacent the front cutting face of the volume of polycrystalline diamond being at least substantially free of the catalyst material in interstitial spaces between inter-bonded diamond grains of the polycrystalline diamond, the annular second region of the volume of polycrystalline diamond not contacting the third region of the volume of polycrystalline diamond.

Although the foregoing description contains many specifics, these are not to be construed as limiting the scope of the present invention, but merely as providing certain exemplary embodiments. Similarly, other embodiments of the invention may be devised which do not depart from the spirit or scope of the present disclosure. For example, features described herein with reference to one embodiment also may be provided in others of the embodiments described herein. The scope of the invention is, therefore, indicated and limited only by the appended claims and their legal equivalents, rather than by the foregoing description. All additions, deletions, and modifications to the disclosed embodiments, which fall within the meaning and scope of the claims, are encompassed by the present disclosure.

What is claimed is:

1. A polycrystalline diamond compact (PDC) cutting element, comprising:

a substrate; and a volume of polycrystalline diamond on the substrate, the volume of polycrystalline diamond having a front cutting face, a lateral side surface, and a cutting edge defined between the front cutting face and the lateral side surface;

wherein a first region of the volume of polycrystalline diamond adjacent at least a portion of an interface between the volume of polycrystalline diamond and the substrate includes catalyst material in interstitial spaces between inter-bonded diamond grains of the polycrystalline diamond; and wherein an annular second region of the volume of polycrystalline diamond adjacent at least a portion of the lateral side surface of the volume of polycrystalline diamond is at least substantially free of the catalyst material; and wherein an inner boundary of the second annular region remote from the lateral side surface of the volume of polycrystalline diamond defines at least a portion of an interface between the first region and the annular second region of the volume of polycrystalline diamond, the interface having a non-linear profile in a plane extending through the PDC cutting element along a longitudinal axis of the cutting element, the non-linear profile including a linear section and a non-linear section, the non-linear section located closer to the interface between the volume of polycrystalline diamond and the substrate relative to the linear section.

2. The PDC cutting element of claim 1, wherein the non-linear section comprises at least one curved section.

3. The PDC cutting element of claim 1, wherein the non-linear section comprises a plurality of curved sections forming an undulating shape.

4. The PDC cutting element of claim 1, wherein the non-linear section comprises a single curved section.

5. The PDC cutting element of claim 1, wherein:

the linear section extends a first distance from the lateral side surface of the volume of polycrystalline diamond into the volume of polycrystalline diamond;

the non-linear section extends a second distance from the lateral side surface of the volume of polycrystalline diamond into the volume of polycrystalline diamond; and the second distance being greater than the first distance.

6. The PDC cutting element of claim 1, wherein the annular second region of the volume of polycrystalline diamond does not contact an interface between the volume of polycrystalline diamond and the substrate.

7. The PDC cutting element of claim 1, wherein the annular second region of the volume of polycrystalline diamond is in a state of compressive stress proximate to the cutting edge at ambient conditions after manufacture and prior to use of the PDC cutting element.

8. The PDC cutting element of claim 1, wherein the annular second region of the volume of polycrystalline diamond extends across the entire area of the front cutting face of the volume of polycrystalline diamond.

9. The PDC cutting element of claim 8, wherein an interface between the first region of polycrystalline diamond and a portion of the annular second region extending across the front cutting face of the volume of polycrystalline diamond is linear.

10. An earth-boring tool, comprising:

a body; and at least one polycrystalline diamond compact cutting element secured to the body, the at least one polycrystalline diamond compact cutting element including:

a substrate; and a volume of polycrystalline diamond on the substrate, the volume of polycrystalline diamond having a front cutting face, a lateral side surface, and a cutting edge defined between the front cutting face and the lateral side surface;

wherein a first region of the volume of polycrystalline diamond adjacent at least a portion of an interface between the volume of polycrystalline diamond and the substrate includes catalyst material in interstitial spaces between inter-bonded diamond grains of the polycrystalline diamond; and wherein an annular second region of the volume of polycrystalline diamond adjacent at least a portion of the lateral side surface of the volume of polycrystalline diamond is at least substantially free of the catalyst material; and wherein an inner boundary of the second annular region remote from the lateral side surface of the volume of polycrystalline diamond defines at least a portion of an interface between the first region and the annular second region of the volume of polycrystalline diamond, the interface having a non-linear profile in a plane extending through the PDC cutting element along a longitudinal axis of the cutting element, the interface having a non-linear profile, the non-linear profile including a linear section and a non-linear section, the non-linear section located closer to the interface between the volume of polycrystalline diamond and the substrate relative to the linear section.

11. The earth-boring tool of claim 10, wherein the earth-boring tool comprises one of a drill bit, a reamer, or a mill.

12. A method of forming a cutting element, comprising:

providing a volume of polycrystalline diamond on a substrate, the volume of polycrystalline diamond having a front cutting face, a lateral side surface, and a cutting edge defined between the front cutting face and the lateral side surface, the volume of polycrystalline diamond material including catalyst material in the interstitial spaces between inter-bonded diamond grains of polycrystalline diamond;

removing a portion of the catalyst material in the interstitial spaces between the inter-bonded diamond grains to leave a first region having catalyst material in interstitial spaces between the inter-bonded diamond grains and to form a second annular region at least substantially free of the catalyst material between the inter-bonded diamond grains, the first region provided adjacent to at least a portion of an interface between the volume of polycrystalline diamond and the substrate, the second annular region formed adjacent at least a portion of the lateral side surface of the volume of polycrystalline diamond; and wherein an inner boundary of the second annular region remote from the lateral side surface of the volume of polycrystalline diamond defines at least a portion of an interface between the second annular region and the second region of the volume of polycrystalline diamond, the interface having a non-linear profile in a plane extending through the PDC cutting element along a longitudinal axis of the cutting element, the non-linear profile including a linear section and a non-linear section, the non-linear section located closer to the interface between the volume of polycrystalline diamond and the substrate relative to the linear section.

13. The method of claim 12, wherein removing the catalyst material in the interstitial spaces between the inter-bonded diamond grains to form the second annular region at least substantially free of the catalyst material between the inter-bonded diamond grains comprises:

providing an annular mask extending circumferentially around and on the lateral side surface of the volume of polycrystalline diamond; and exposing the volume of polycrystalline diamond to a leaching agent to remove the catalyst material from interstitial spaces between inter-bonded diamond grains in the second annular region of the volume of polycrystalline diamond.

14. The method of claim 13, wherein providing the annular mask extending circumferentially around and on the lateral side surface of the volume of polycrystalline diamond comprises providing an annular mask that does not contact the front cutting face of the polycrystalline diamond and does not contact the substrate around and on the volume of polycrystalline diamond.

15. The method of claim 13, further comprising:

removing the annular mask; and subjecting a region of the volume of polycrystalline diamond around and on which the annular mask was previously provided to a leaching agent to remove the catalyst material from interstitial spaces between inter-bonded diamond grains in the second annular region of the volume of polycrystalline diamond.

16. The method of claim 12, wherein removing the catalyst material in the interstitial spaces between the inter-bonded diamond grains to form a second annular region at least substantially free of the catalyst material between the inter-bonded diamond grains comprises forming the non-linear section of the non-linear profile between the second annular region and the second region to comprise at least one curved section.

17. The method of claim 12, wherein removing the catalyst material in the interstitial spaces between the inter-bonded diamond grains to form a second annular region at least substantially free of the catalyst material between the inter-bonded diamond grains comprises forming the non-linear section of the non-linear profile between the second annular region and the second region to comprise a plurality of curved sections forming an undulating shape.

18. The method of claim 12, wherein removing the catalyst material in the interstitial spaces between the inter-bonded diamond grains to form a second annular region at least substantially free of the catalyst material between the inter-bonded diamond grains comprises forming the non-linear section of the non-linear profile between the second annular region and the second region such that the non-linear section extends a first depth from the lateral side surface into the volume of polycrystalline diamond and the linear section extends a second depth from the lateral side surface into the volume of polycrystalline diamond, the first depth being greater than the second depth.

19. The method of claim 12, further comprising forming the second annular region in a state of compressive stress proximate to the cutting edge at ambient conditions after manufacture and prior to use of the PDC cutting element.

20. The method of claim 12, further comprising providing a mask extending about exterior surfaces of the substrate.

* * * * *